US008683838B2

(12) United States Patent
Vinzant et al.

(10) Patent No.: US 8,683,838 B2
(45) Date of Patent: Apr. 1, 2014

(54) CIRCULAR ROLLING MILL WITH SHAPING ROLLER

(76) Inventors: Guy Vinzant, Manigod (FR); Alain Kaczorek, Saint Etienne (FR)

( * ) Notice: Subject to any disclaimer, the term of this patent is extended or adjusted under 35 U.S.C. 154(b) by 588 days.

(21) Appl. No.: 12/736,629

(22) PCT Filed: Mar. 20, 2009

(86) PCT No.: PCT/FR2009/050474
§ 371 (c)(1),
(2), (4) Date: Jan. 11, 2011

(87) PCT Pub. No.: WO2009/125102
PCT Pub. Date: Oct. 15, 2009

(65) Prior Publication Data
US 2011/0138871 A1 Jun. 16, 2011

(30) Foreign Application Priority Data
Mar. 21, 2008 (FR) ..... 08 51834

(51) Int. Cl.
*B21B 1/08* (2006.01)

(52) U.S. Cl.
USPC ..... 72/110; 72/106; 72/107

(58) Field of Classification Search
USPC ..... 72/110–112, 115, 118, 119, 449, 101, 72/105–109, 120, 121
See application file for complete search history.

(56) References Cited

U.S. PATENT DOCUMENTS

| | | | | |
|---|---|---|---|---|
| 3,698,218 | A | 10/1972 | Wieting | |
| 4,339,937 | A * | 7/1982 | Strugala et al. | 72/110 |
| 4,869,088 | A * | 9/1989 | Kadotani | 72/11.1 |
| 2010/0269560 | A1 * | 10/2010 | Anderson et al. | 72/350 |

FOREIGN PATENT DOCUMENTS

| | | |
|---|---|---|
| DE | 26 34 625 | 2/1978 |
| DE | 29 23 001 | 1/1981 |
| DE | 44 21 596 | 1/1996 |
| FR | 2 014 080 | 4/1970 |

OTHER PUBLICATIONS

International Search Report.

* cited by examiner

*Primary Examiner* — Debra Sullivan
(74) *Attorney, Agent, or Firm* — Collard & Roe, P.C.

(57) ABSTRACT

This circular rolling mill (1), used for shaping annular workpieces (100), comprises a pair of rollers, an inner one (12) and an outer one (10), capable of working ($F_1$+$F_2$) the radial inner (102) and outer (101) faces of a workpiece, and a pair of conical rollers, an upper one (22) and a lower one (20), capable of working ($F_4$+$F_5$) the front faces (103, 104) of the workpiece, and also means (66) for moving some of these rollers (22) with respect to a frame (41) of the rolling mill (1). The means for moving at least one of the rollers (22) comprise at least one pinion (54, 55) and at least one rack (26, 28) which is secured to a member for the movement ($F_3$) of the roller. This pinion (54, 55) is rotated by the output shaft of an electrically operated geared motor (66) mounted on a support (72) which is articulated with respect to the frame about the axis ($X_{56}$) parallel to the axis of rotation of the pinion. Damping means (76) are provided for damping the pivoting movement of the support (72) about its articular axis ($X_{56}$).

10 Claims, 8 Drawing Sheets

CIRCULAR ROLLING MILL WITH SHAPING ROLLER

CROSS REFERENCE TO RELATED APPLICATIONS

This application is the National Stage of PCT/FR2009/050474 filed on Mar. 20, 2009, which claims priority under 35 U.S.C. §119 of French Application No. 08 51834 filed on Mar. 21, 2008, the disclosure of which is incorporated by reference. The international application under PCT article 21(2) was not published in English.

BACKGROUND OF THE INVENTION

1. Field of the Invention

The invention relates to a circular rolling mill used for shaping annular workpieces, such as forged metal pulley or wheel blanks or other similar workpieces.

2. The Prior Art

It is known, for example from FR-A-2 014 080, to use a circular rolling mill with four rollers to form annular workpieces. Two cylindrical rollers are used to work respectively the radial outer and inner faces of the annular workpiece, while a pair of conical rollers is used to work the front faces of the workpiece. Electric motors are used to rotate at least some of these rollers. These rollers have to be displaced with respect to one another, this being to take account of dimensional variations in the workpiece during its rolling and to exert shaping forces on its inner, outer or front faces. In order to do this, use is made of hydraulic jacks which allow considerable forces to be generated over paths of relatively small amplitude. The use of such jacks makes it necessary to maintain the functioning of a hydraulic power unit and to control distributors for the distribution of the operating oil of the jacks. This requires periodic checks and relatively complex maintenance operations. Oil leaks cannot be ruled out, thus giving rise to the risk of fire.

It is these drawbacks in particular that the invention is intended to overcome by proposing a circular rolling mill, the operation whereof is rendered reliable and the maintenance whereof can be facilitated, without impairing the quality of the rolling obtained or the robustness of the rolling mill.

SUMMARY OF THE INVENTION

For this purpose, the invention relates to a circular rolling mill for the shaping of annular workpieces, this rolling mill comprising a pair of rollers, an inner one and an outer one, capable of working the radial inner and outer faces of a workpiece as well as a pair of conical rollers, an upper one and a lower one, capable of working the front faces of this workpiece. This rolling mill also comprises means for moving at least some of these rollers with respect to a frame. This rolling mill is characterised in that the means for moving at least one of the rollers comprise at least one pinion and at least one rack which is secured to a member for the movement of the roller, in that the pinion is rotated by the output shaft of an electrically operated geared motor mounted on a support which is articulated with respect to the frame about the axis of rotation of the pinion and in that damping means are provided for damping the pivoting movement of the support about its articular axis.

Thanks to the invention, the transmission of force between the electrically operated geared motor and the working or shaping roller is achieved in a reliable manner, even under a great load, thanks to the use of a linkage of the pinion/rack type. Moreover, the fact that the geared motor is mounted on a support which is articulated with respect to the frame of the rolling mill is such that, in the case of an irregularity of the surface with which the roller interacts, the temporary overload transmitted to the rack due to this irregularity can be transferred without damage to the pinion, while the latter tends to rotate in an opposite direction to that normally imposed by the geared motor. A considerable resisting torque thus results at the pinion, this torque being able to be absorbed due to the pivoting movement of the support about the axis of rotation of the pinion and with respect to the frame of the rolling mill. These damping means make it possible to absorb the corresponding energy, without an excessively large load on the geared motor.

According to advantageous, but non-obligatory aspects of the invention, such a rolling mill can incorporate one or more of the following features:

- The upper conical roller is mounted on a carriage displaceable in a vertical direction and on which the rack is fixed, the pinion/rack assembly being capable of exerting on the carriage a vertical force directed towards the lower conical roller, which permits efficient shaping of the front faces of the workpiece to be treated.
- The inner roller is mounted on a carriage displaceable in a horizontal direction and on which the rack is fixed, the pinion/rack assembly being capable of exerting on the carriage a horizontal force directed towards the outer cylindrical roller, which permits efficient shaping of the inner and outer faces of the workpiece to be treated.
- The carriage which supports the roller carries at least two racks each engaged with a pinion, each pinion being rotated by the output shaft of an electrically operated geared motor mounted on an independent support which is articulated on the frame about the axis of rotation of the pinion, in that the axes of rotation of the pinions are parallel to one another, while damping means for the pivoting movement of each support are provided. The fact that the carriage carries two racks allows the transmitted forces to be distributed between the geared motors and the roller, thereby balancing the latter.
- The rolling mill also comprises at least one roller for tracking and centering the radial outer surface of the workpiece to be treated, while each centering roller is mounted on a mobile arm integral with a first pinion engaged with a second opinion, the second pinion is driven by the output shaft of the electrically operated geared motor on a support which is articulated with respect to the frame about an axis parallel to the axis of rotation of the pinion and damping means are provided between the support and the frame in order to damp the pivoting movement of the support about its articular axis. In other words, the displacement of the tracking rollers is brought about in a manner comparable to the displacement of the shaping rollers.
- The rolling mill comprises means for detecting the pivoting movement of the support with respect to the frame, these means being capable of supplying a signal representative of this pivoting movement to an electronic control unit of the rolling mill. By taking account of this signal, it is possible to adapt the operation of the rolling mill, in particular the rotation speed of the roller or rollers concerned, in order to take account of a surface irregularity resulting in the pivoting movement of the support. In this case, provision can be made such that the electronic unit can control two geared motors as a function of the signals received from the detection means in order to ensure a coordinated operation of the means for displacement of at least one of the rollers.

The damping means comprise a rod linked to the support and integral with a mobile piston inside a body which is itself integral with the frame, thereby defining a variable-volume chamber which contains an element which is elastically deformable by compression. In this case, the detection means are advantageously capable of detecting a displacement of the rod with respect to the body. Provision can also be made such that the elastically deformable element disposed in the variable-volume chamber is a stack of Belleville washers.

BRIEF DESCRIPTION OF THE DRAWINGS

The invention will be better understood and other advantages of the latter will appear more clearly in the light of the following description of an embodiment of a rolling mill according to its principle, given solely by way of example and making reference to the appended drawings, in which.

DETAILED DESCRIPTION OF PREFERRED EMBODIMENT

Figure 1:
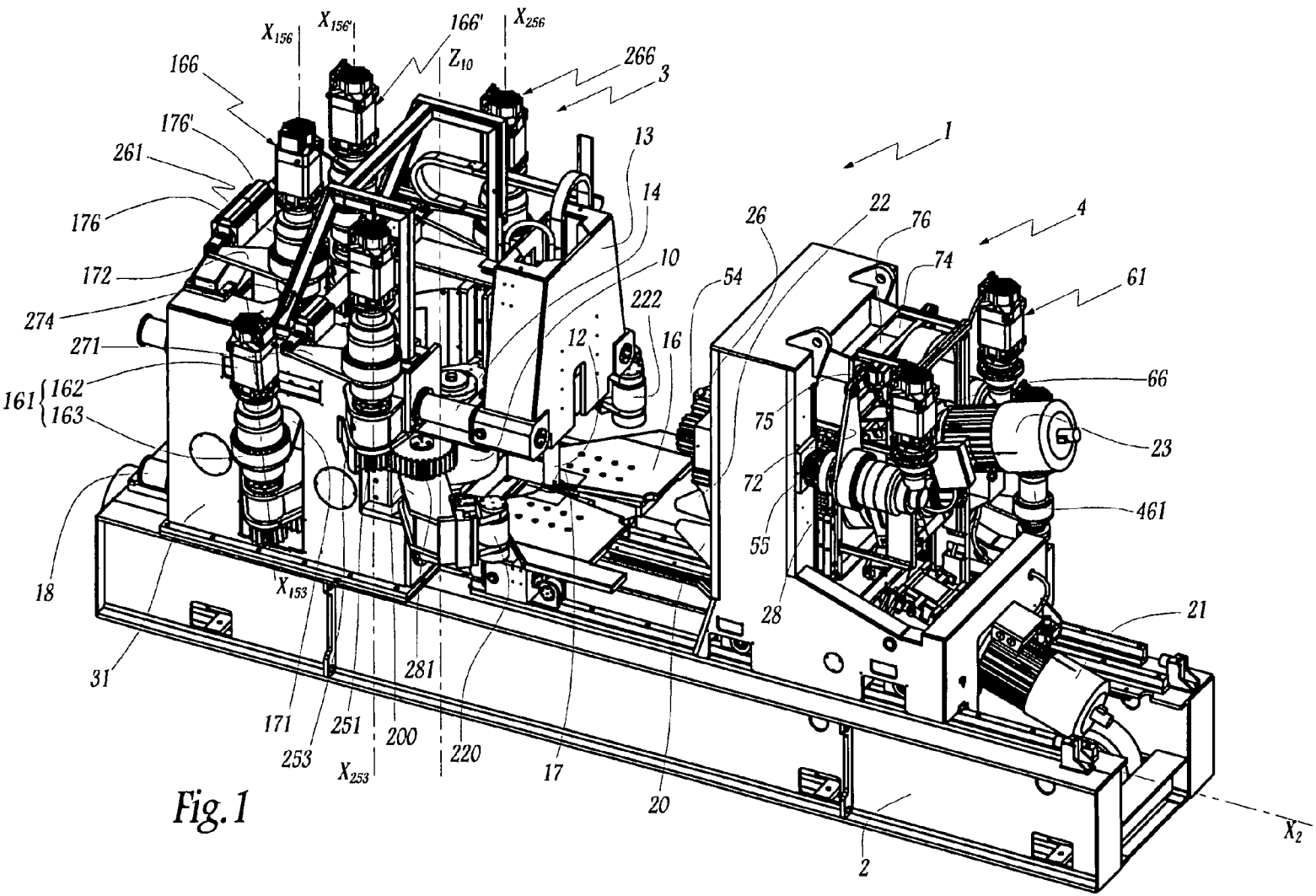
FIG. 1 is a perspective view of a rolling mill according to the invention.

Rolling mill 1 represented in FIGS. 1 to 7 comprises a main frame 2 on which there is mounted a radial cage 3 fixed with respect to frame 2 as well as an axial cage 4 mobile parallel to a longitudinal axis $X_2$ of frame 2.

Cage 3 carries a cylindrical roller 10 with a circular base mounted so as to rotate about a vertical axis $Z_{10}$ and rotated by a main electric motor 11.

Cage 3 also carries a secondary roller or mandrel 12 mounted so as to rotate about an axis $Z_{12}$ parallel to axis $Z_{10}$ inside a column 13 which is mobile, with respect to a main part 31 of cage 3, parallel to axis $X_2$. Column 13 is supported by two bars 14 and 15 capable of sliding with respect to part 31, as emerges from the following explanations. Cage 3 also comprises a plate 16 which defines a seating 17 for receiving the lower end of mandrel 12 when column 13 and plate 16 are vertically aligned, i.e. when axis $Z_{12}$ passes through the centre of seating 17. It is therefore in fact possible to lower mandrel 12 in order to engage it partially in seating 17.

Plate 16 is supported by two bars 18 and 19 which extend parallel to bars 14 and 15 and to axis $X_2$.

Rolling mill 1 also comprises a lower conical roller 20 supported by axial cage 4 and rotated by an electric motor 21. Cage 4 also supports an upper conical roller 22 rotated by an electric motor 23.

The axes of symmetry and rotation of rollers 20 and 21 are denoted respectively by $A_{20}$ and $A_{22}$. These axes are convergent and approach one another in the direction of radial cage 3.

Figure 2:
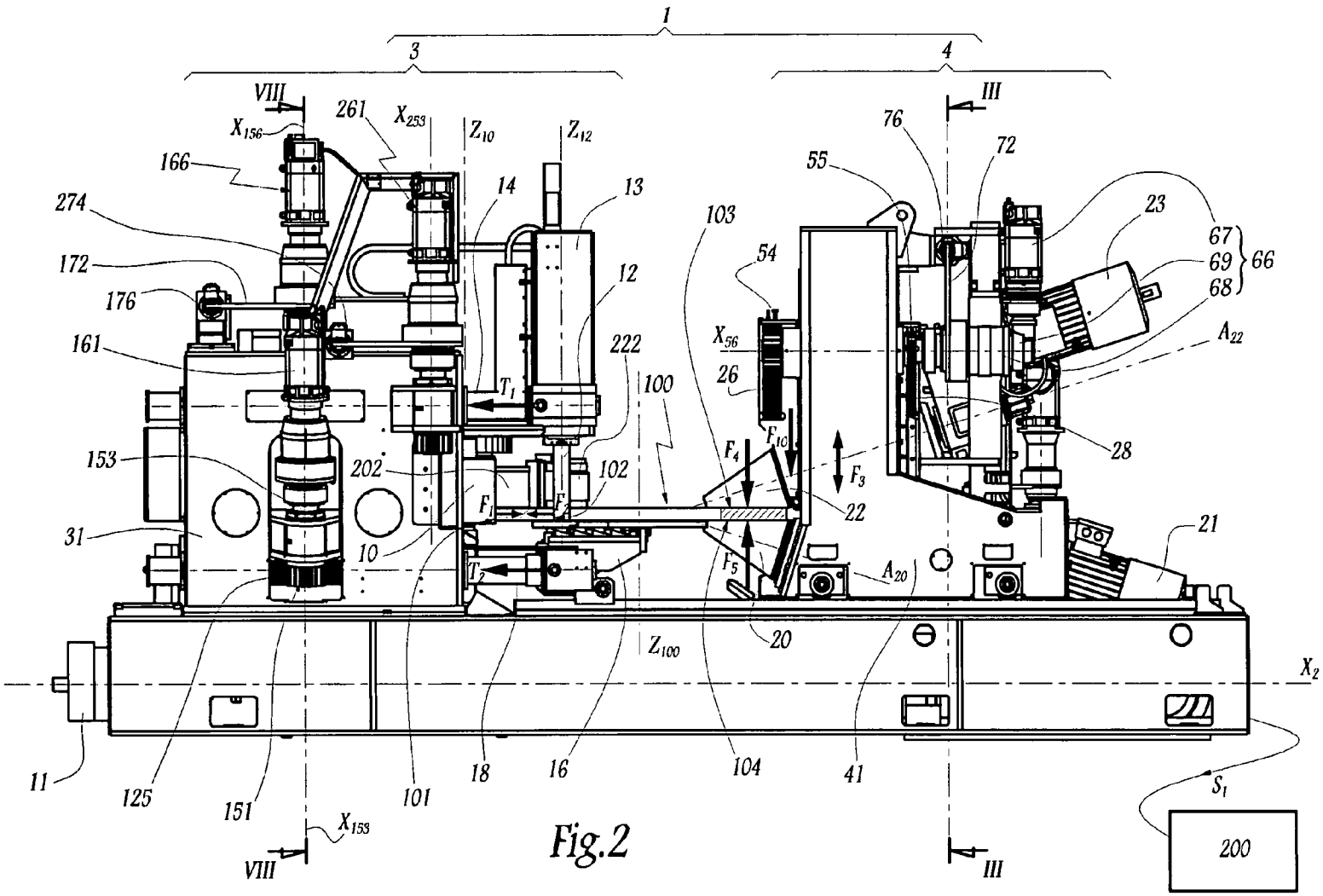
FIG. 2 is a side view of the rolling mill of FIG. 1 when the latter is in the course of rolling an annular collar.
Figure 3:
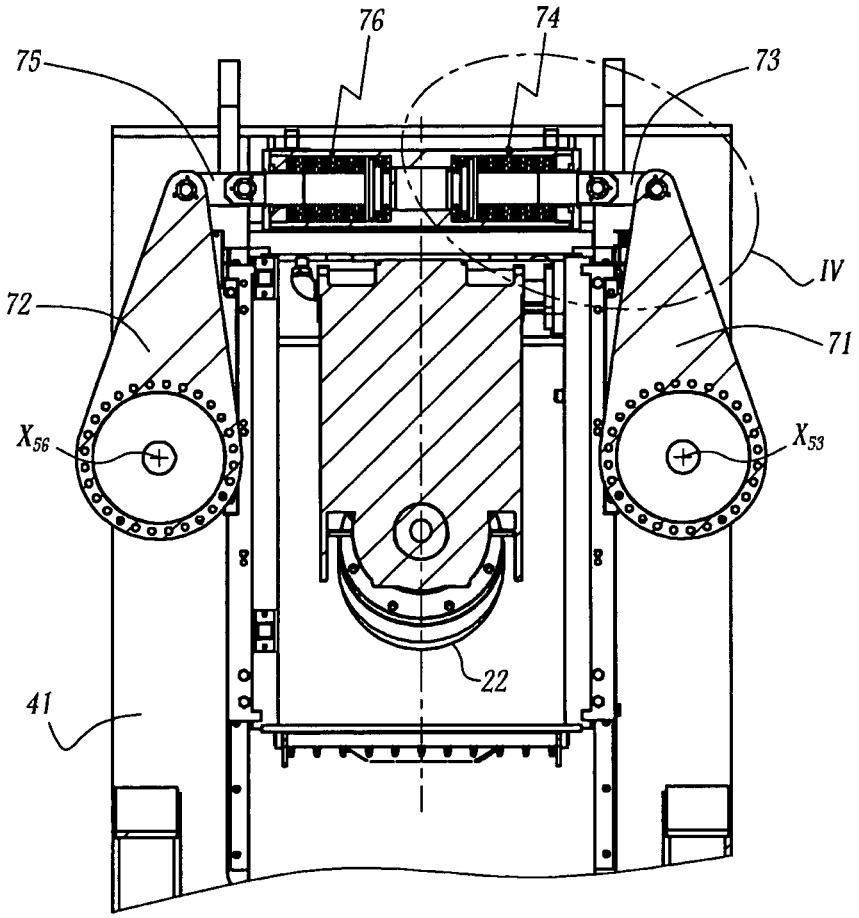
FIG. 3 is a cross-section on a larger scale through line III-III in FIG. 2 of the upper part of the rolling mill, which is represented in the configuration of FIG. 1, i.e. empty.

When a workpiece to be rolled 100 is in place in rolling mill 1, as represented solely in FIG. 2, this workpiece is subjected to radial compressive forces $F_1$ and $F_2$ exerted respectively by rollers 10 and 12. These forces $F_1$ and $F_2$ make it possible to shape respectively radial outer surface 101 and radial inner surface 102 of workpiece 100. The intensity of these forces depends on the intensity of two tractive forces $T_1$ and $T_2$ exerted respectively on column 13 and on plate 16 by means of bars 14, 15, 18 and 19 and directed towards part 31 of radial cage 3.

Roller 20 is supported by frame 41 of axial cage 4 with its axis $A_{20}$ fixed with respect to this frame. In other words, roller 20 can only rotate about axis $A_{20}$. In contrast, roller 22 is supported with respect to frame 41 with a possibility of vertical displacement in translation, parallel to axes $Z_{10}$ and $Z_{12}$, as represented by double arrow $F_3$ in FIG. 2. This possibility of vertical displacement of axis $A_{22}$ allows roller 22 to exert, on the front upper face 103 of workpiece 100, a force $F_4$ directed towards roller 20. The effect of this is to induce a force of reaction $F_5$ of roller 20 on lower front face 104 of workpiece 100. Thus, by displacing roller 22 more or less in the direction of double arrow $F_3$, it is possible to exert, directly on face 103 and indirectly on face 104, a force for shaping these faces.

In order to be able to be displaced in the direction of double arrow $F_3$, roller 22 is mounted on a carriage 24 provided with two racks 25 and 26 disposed vertically, i.e. parallel to the direction of double arrow $F_3$. Carriage 24 is mounted so as to be sliding with respect to bars 42 which form the framework of frame 41 and which can be seen in FIGS. 5 and 6, where the covering of frame 41 is not represented. It will be noted in these figures that carriage 24 in fact carries four racks, i.e. two racks 25 and 26 disposed on carriage 24 appreciably above roller 22 and two racks 27 and 28 located on the other side of frame 41 with respect to roller 22.

Pinions 51 and 52 are mounted on a shaft 53 which extends parallel to axis $X_2$. Pinions 51 and 52 are respectively engaged with racks 25 and 27. Shaft 53 constitutes the output shaft of geared motor 61 constituted by an electric motor 62 and a reversible step-down gear 63 linked by a 90° bevel gear 64.

In the same way, two pinions 54 and 55 are mounted on a shaft 56 and respectively engaged with toothings 26 and 28. Shaft 56 constitutes the output shaft of geared motor 66 comprising an electric motor 67, a reversible step-down gear 68 and a 90° bevel gear 69.

Step-down gear 63 or 68 of each geared motor 61 or 66 supports the associated motor and bevel gear.

Step-down gear 63 is mounted on a reaction arm 71 which is articulated on frame 41 about longitudinal axis $X_{53}$ of shaft 53, which forms the axis of rotation of pinions 51 and 52 and which is parallel to axis $X_2$. In the same way, step-down gear 68 is mounted on reaction arm 72 which forms a support and is articulated with respect to frame 41 about longitudinal axis $X_{56}$ of shaft 56, which forms the axis of rotation of pinions 54 and 55 and which is parallel to axes $X_{53}$ and $X_2$. Geared motors 61 and 66 are supported by arms 71 and 72, respectively via step-down gears 63 and 68.

Arm or support 71 is connected by a connecting rod strap to a damper 74. In the same way, articulated support 72 is connected by a connecting rod strap 75 to a damper 76. In practice, dampers 74 and 76 are mounted upside down and fixed at the upper part of frame 41, overall in a horizontal direction perpendicular to axis $X_2$.

The various electric motors of rolling mill 1 are controlled by an electronic unit 200 represented only schematically in FIG. 2 and connected to rolling mill 1 by a cable bundle 201. Unit 200 coordinates the movements of the various geared motors of rolling mill 1, for example geared motors 61 and 66, in order to ensure effective vertical translation of carriage 24.

During normal operation of rolling mill 1, the various motors and geared motors are controlled by unit 200 according to a pre-established rolling range. The effect of this is to exert shaping forces $F_1$, $F_2$, $F_4$ and $F_5$ on surfaces 101 to 104 of workpiece 100 to be treated and by means of shaping rollers 10, 12, 20 and 22. In particular, the rotating of shafts 53 and 56 by means of geared motors 61 and 66 makes it possible to exert on carriage 24 a vertical force $F_{10}$, parallel to axes $Z_{10}$ and $Z_{12}$, which is transmitted to roller 22 in order to create force $F_4$ and, via reaction of roller 20, force $F_5$ on faces 103 and 104.

Faces 103 and 104 are usually plane and regular. It may happen however that the surfaces have a projecting irregularity, in particular following a stoppage of the rolling mill. In this case, when workpiece 100 is rotated about its central axis $Z_{100}$, the height of workpiece 100 between rollers 20 and 22 may increase abruptly. This tends to cause carriage 24 to rise with respect to frame 41, thereby giving rise, through a corresponding displacement of racks 25 to 28, to a rotational movement of pinions 51, 52, 54 and 55 in a direction opposite to the torque exerted by geared motors 61 and 66. Due to the reversible nature of the pinion/rack transmissions, the reversed rotary movement of the pinions is transmitted to shafts 53 and 56. This reversed movement tends to cause these shafts to rotate in a direction opposite to that imposed by geared motors 61 and 66. In other words, the torque transmitted to shafts 53 and 56 due to a projecting irregularity on one of surfaces 103 or 104 is opposing to that resulting from the action of motors 62 and 67. Opposing torques thus result on shafts 53 and 56 and on the shafts of step-down gears 63 and 68. These opposing forces are absorbed due to the mounting of geared motors 61 and 66 on reaction arms 71 and 72 which can pivot respectively about axes $X_{53}$ and $X_{56}$. This pivoting movement is damped by dampers 74 and 76 which in fact absorb the energy associated with the raising of carriage 24.

Figure 6:
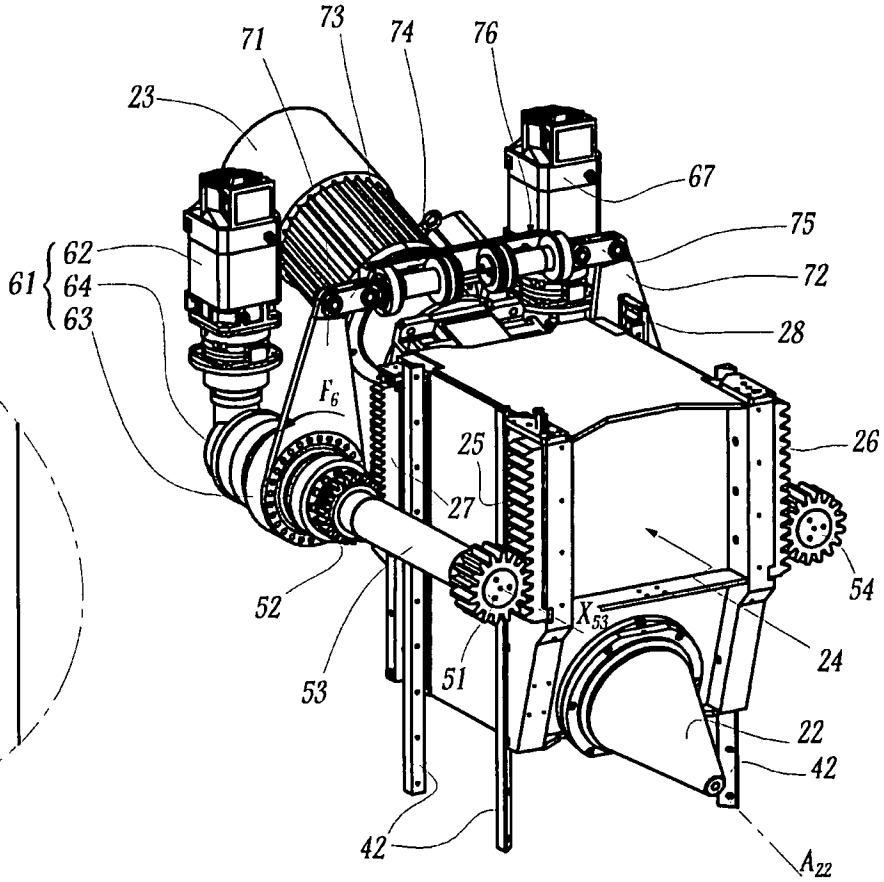
FIG. 6 is a perspective view, at an angle opposite to that of FIG. 5, of the upper part of the axial cage shown in FIG. 5.
Figure 4:
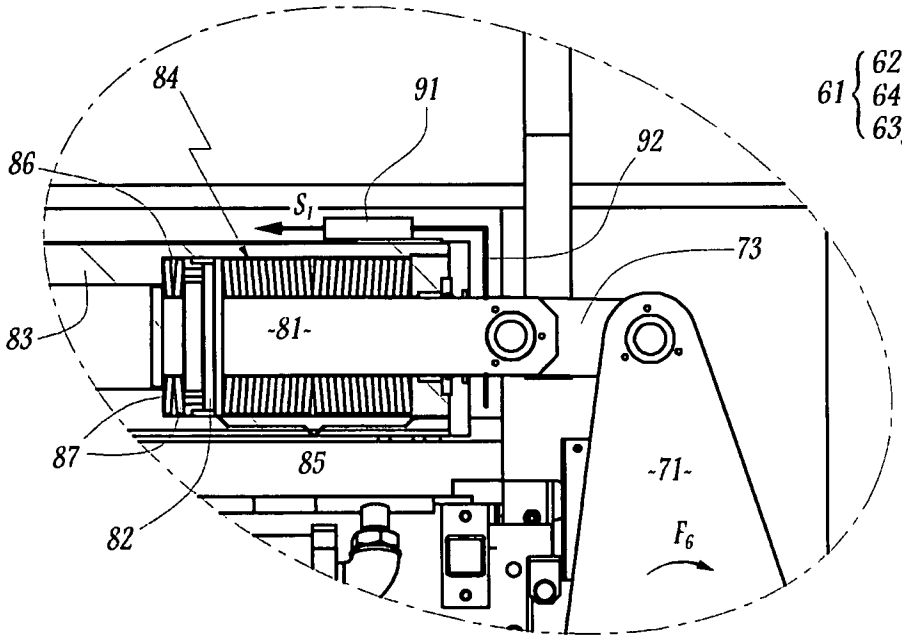
FIG. 4 is a view on a larger scale of detail IV in FIG. 3.
Figure 5:
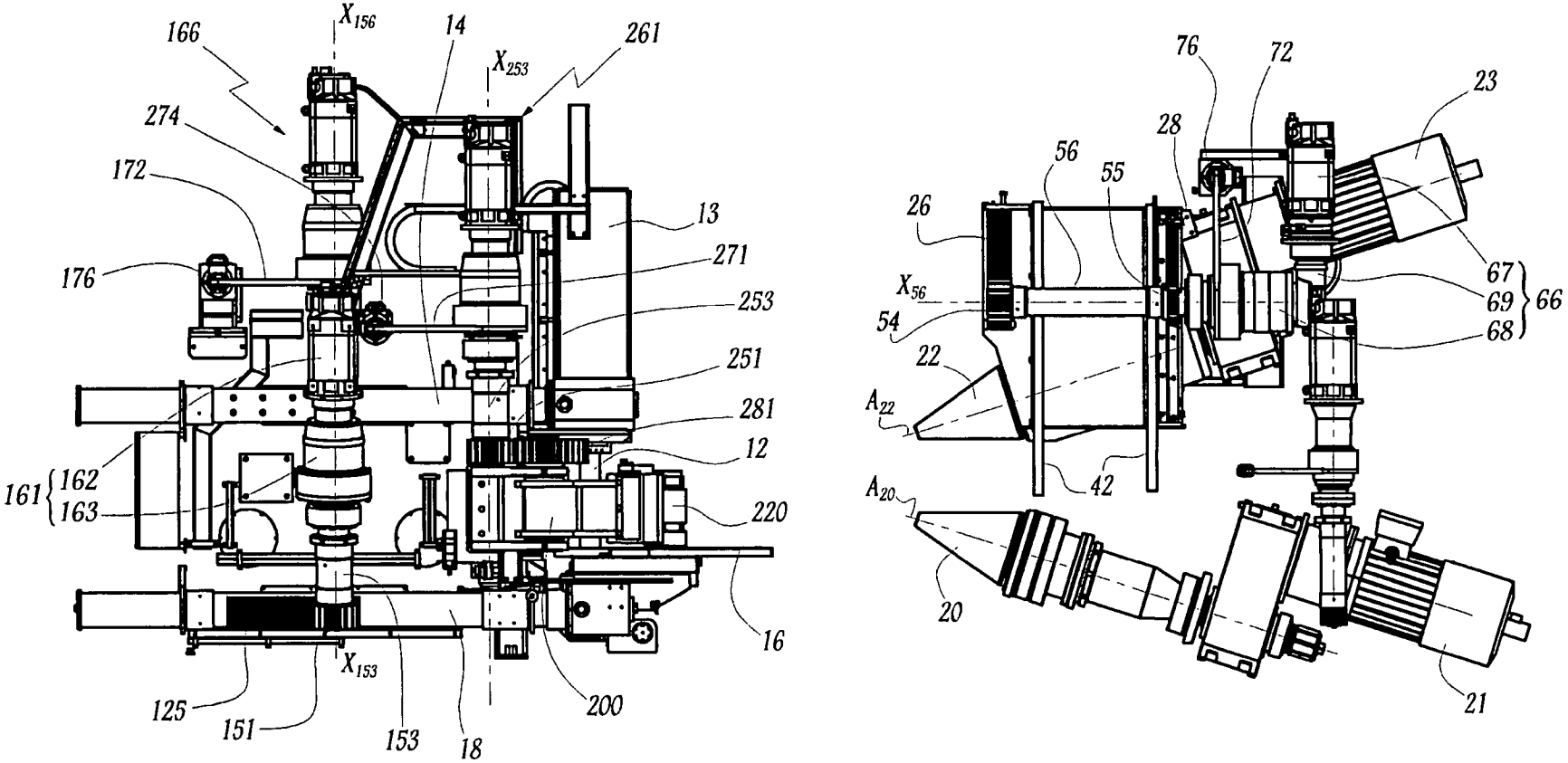
FIG. 5 is a cross-sectional view, in the same direction as FIG. 2, of several elements for driving mobile parts of the rolling mill of FIGS. 1 to 4.
Figure 7:
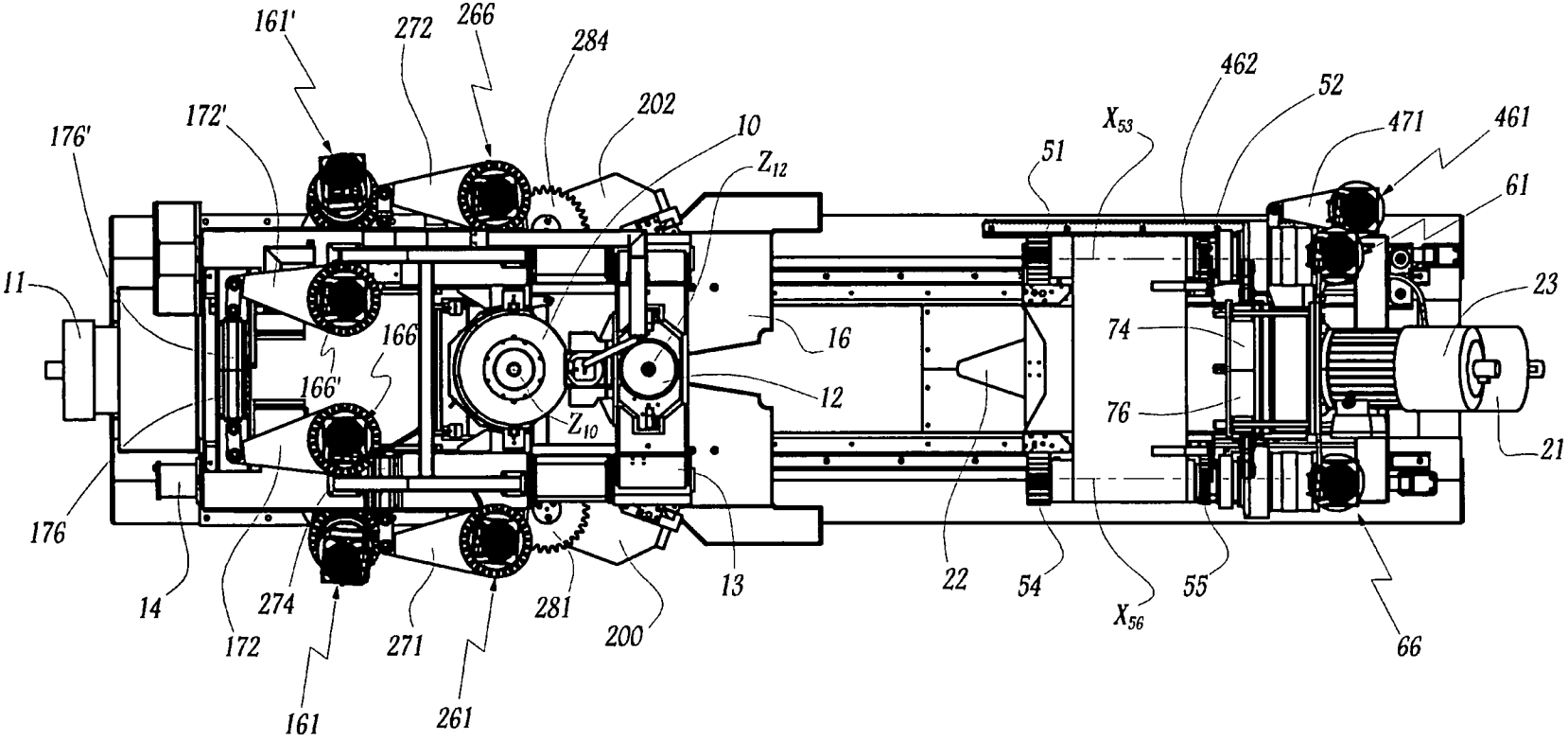
FIG. 7 is a plan view of the rolling mill of FIGS. 1 to 6.

As emerges more particularly from FIG. 4, damper 74 comprises a rod 81 integral with a piston 82 mounted inside a body 83 common to the two dampers 74 and 76. Connecting rod 73 is articulated on rod 81, such that the effect of the pivoting movement of reaction arm 71 about axis $X_{53}$ with respect to frame 41 is to displace piston 82 inside body 83, towards the left in FIG. 4. The articulation points of connecting rod 73 on arm 71, on the one hand, and on rod 81, on the other hand, are defined such that the effect of the pivoting movement of arm 71 about axes $X_{53}$, which takes place in the direction of arrow $F_6$ in FIGS. 4 and 6, is to displace piston 81 in a direction reducing the volume of a chamber 84 defined inside body 83 and in which a stack 85 of Belleville washers is disposed. The crushing of the stack of washers 85 makes it possible to damp the pivoting movement of arm 71 in the direction of arrow $F_6$.

Also disposed in chamber 86 of body 83 defined opposite chamber 84 with respect to piston 82 are two Belleville washers 87, which permit the return of arm 71 towards its normal position to be damped when the opposing force, due to the surface irregularity of workpiece 100, is taken up by geared motors 61 and 66.

A movement detector 91, which is represented solely in FIG. 4 for the sake of clarity of the drawing, is associated with damper 74 and linked to a bent sheet metal 92 fixed on rod 81 and the movement whereof is processed by detector 91 to emit a corresponding signal $S_1$ in the direction of unit 200. Thus, when arm 71 pivots about axis $X_{71}$ as a result of the raising of carriage 24 due to a projecting irregularity on one of surfaces 103 or 104, signal $S_1$ is transmitted to unit 200 which can then be programmed to slow down the rotational speed of rollers 10, 12, 20 and 22 until the return of arm 71 to its normal position, which is also detected by detector 91.

The shape of detector 91 and of sheet metal 92 represented in FIG. 4 is very schematic. In practice, any suitable type of detector can be used in conjunction with damper 74, for example a detector with a measuring rule, a potentiometer-type detector or a Hall effect detector.

Damper 76 has a structure similar to that of damper 74 and is not described in further detail. It is also associated with a displacement detector which is not represented.

The method of controlling the vertical displacement of roller 22 is also employed for the horizontal displacement of the mandrel or inner roller 12. Bars 14, 15, 18 and 19 are in fact each provided with a rack. Rack 125 of bar 18 is engaged with a pinion 151 mounted on output shaft 153 of geared motor 161 comprising an electric motor 162 and a step-down gear 163. The longitudinal axis of shaft 153, which forms the axis of rotation of pinion 151, is denoted by $X_{153}$. Geared motor 161 is mounted on reaction arm 171 which is articulated on main part 31 of cage 3, about axis $X_{153}$.

Figure 8:
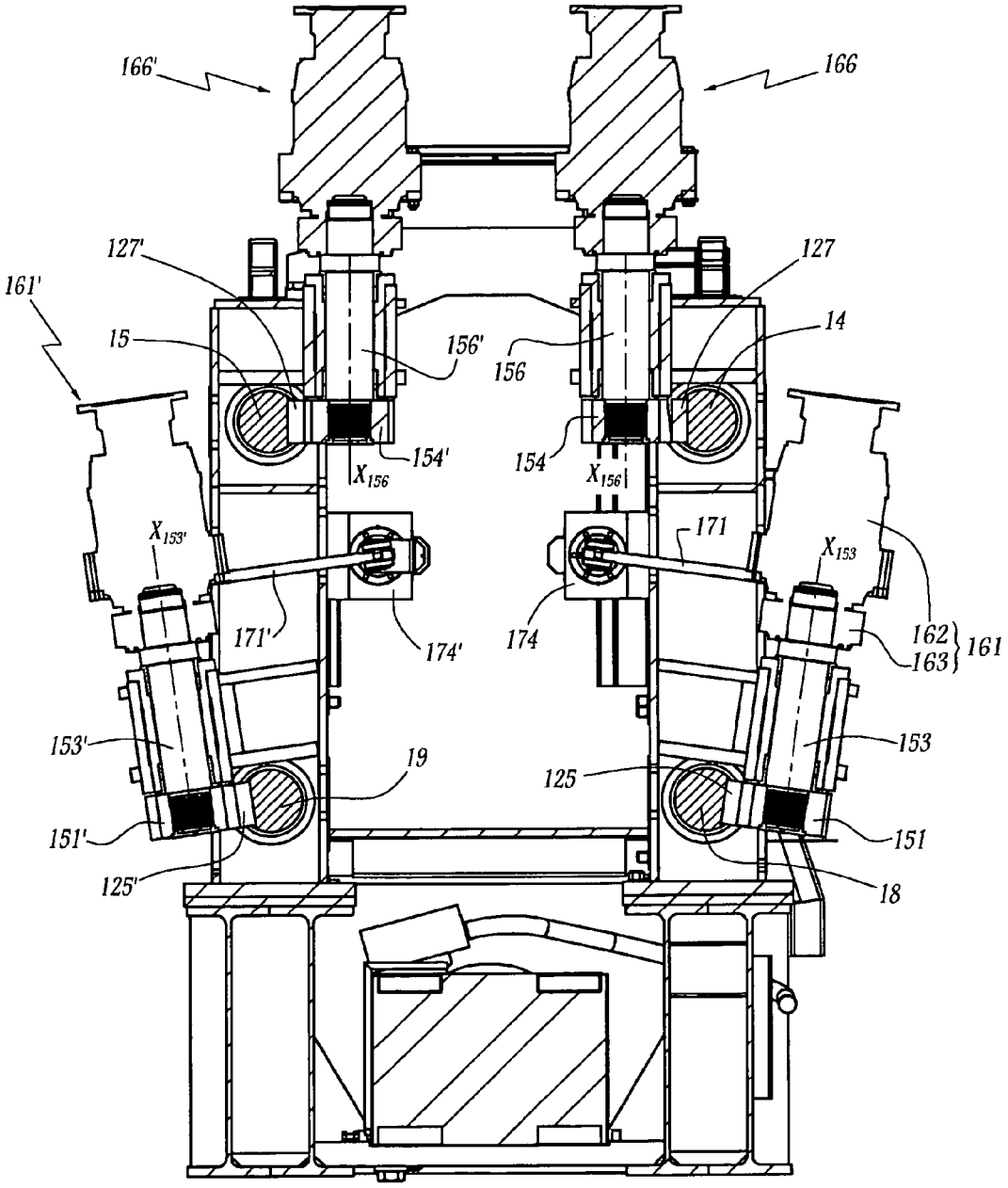
FIG. 8 is a cross-section through line VIII-VIII in FIG. 2.
Figure 9:
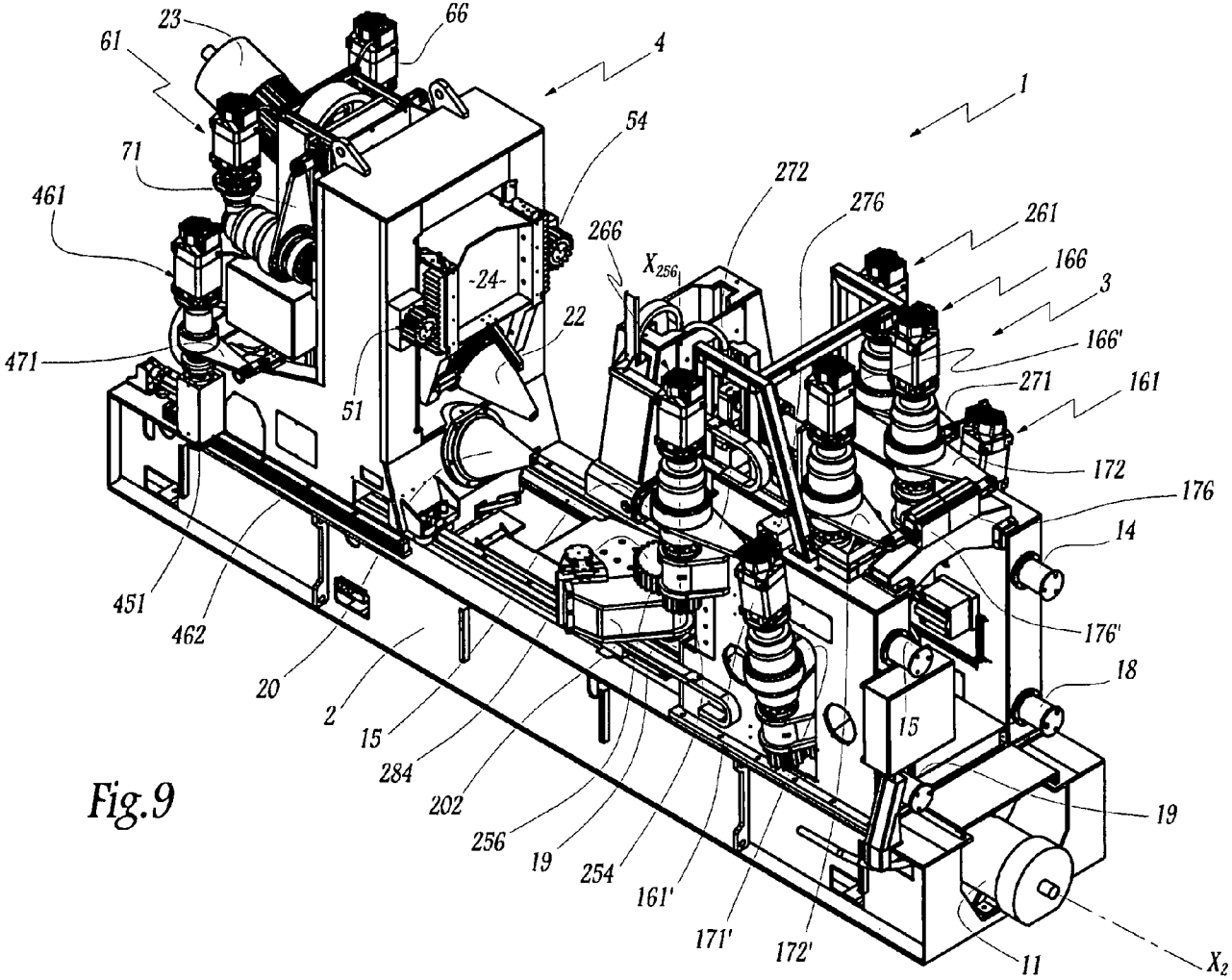
FIG. 9 is a perspective view similar to FIG. 1, at a different angle.

Rack 127 of bar 14 can be seen in FIG. 8, as well as pinion 154 associated with this rack. Pinion 154 is driven by a geared motor 166, the output shaft whereof is denoted by 156. Longitudinal axis $X_{156}$ of shaft 156 forms the axis of rotation of pinion 154. Geared motor 166 is mounted on a reaction arm 172 which is articulated, with respect to part 31, about axis $X_{156}$ which is vertical. Reaction arms 171 and 172 are respectively associated with dampers 174 and 176.

Bars 15 and 19 are also provided with racks, respectively 127' and 125', each engaged with a pinion 154' and 151'. These pinions are each driven by a geared motor 161' or 166' supported by a reaction arm 171', 172' which is articulated on main part 31 of cage 3 about a longitudinal axis $X_{153'}$, $X_{156'}$ of output shaft 153' or 156' of these geared motors which form the axes of rotation of pinions 151' and 154'.

Two dampers 174' and 176' permit the damping of the pivoting movement of arms 171' and 172' respectively about axes $X_{153'}$ and $X_{156'}$.

Unit 200 coordinates the functioning of geared motors 161, 161', 166 and 166' to ensure the effective horizontal translation of the carriage formed by sub-assemblies 13 to 19.

Geared motors 161, 161', 166 and 166' make it possible to exert, on bars 14, 15, 18 and 19 of the carriage constituted by elements 13 to 19, a force directed towards roller 10, i.e. opposite cage 4, and equal to the sum of tractive forces $T_1$ and $T_2$.

This tractive force tends to cause mandrel 12 to approach roller 10 by translation in parallel with axis $X_2$, which allows shaping forces $F_1$ and $F_2$ to be exerted on faces 101 and 102 of workpiece 100. In the case of an irregularity on one of these surfaces, in particular at the start of the rolling process when the blank is relatively irregular, mandrel 12, column 13 and plate 16 can be pushed back temporarily in the direction of central axis $Z_{100}$ of workpiece 100. This is possible due to the pivoting movement of one or more of reaction arms 171, 171', 172 and 172' about their respective articular axes on part 31. This articulation movement is damped by dampers 174, 174', 176 and 176'.

As in the case of the control of roller 22, this pivoting movement of reaction arms 171, 171', 172 and 172' permits the absorption of the opposing torques which are exerted on drive shafts 153, 153', 156 and 156' of pinions 151, 151', 154 and 154'.

Rolling mill 1 is also provided with centering arms 200 and 202 each provided with a roller 220 or 222 intended to abut against surface 101 of workpiece 100 during rolling. Elements 200 and 220 are not represented in FIG. 2 for the sake of clarity of the drawing.

Centering arm 200 is displaced towards central axis $Z_{100}$ of workpiece 100 during rolling by means of electrically operated geared motor 261, output shaft 253 whereof is provided with a pinion 251 which engages with another pinion 281 fixed on arm 200. Similarly, a geared motor 266 has its output shaft 256 provided with a pinion 254 which engages with a second pinion 284 fixed on arm 202.

Each geared motor 261 or 266 is mounted on a support 271 or 272 in the form of a reaction arm which is articulated on part 31 about longitudinal axis $X_{253}$ or $X_{256}$ of output shaft 253 or 256 corresponding to this geared motor. Dampers 274 and 276 similar to those mentioned for controlling the vertical position of roller 22 are used to damp the pivoting movements of reaction arms 271 and 272 about their respective articular axes. These pivoting movements can result from irregularities of surface 101 and are absorbed without damage to pinions 251, 281, 254 and 284 and geared motors 261 and 266.

It is advantageous, in terms of supply, production and maintenance, that dampers 74, 76, 174, 174', 176, 176', 274 and 276 used to absorb the energy due to the pivoting movement of the various reaction arms are identical. This is not however obligatory.

The pivoting movement of reaction arms 171, 171', 172, 172', 271 and 272 can be detected, as explained on the subject of the pivoting of reaction arms 71 and 72. The detection of the pivoting movement of arms 171, 171', 172, 172', 271 and 272 can be used, as explained by reference to detector 91, to signal a surface irregularity to unit 200 which can then adapt the functioning of rolling mill 1.

In practice, a detector of the type such as detector 91 is associated with each arm 171, 171', 172, 172', 271 and 272.

Provision can be made such that, when the pivoting movement of one of the reaction arms has been detected by one of the detectors, the rotation speed of rollers 10, 12, 20 and 22 is reduced, until the return of this reaction arm to the normal position, this also been detected by the detector in question.

Moreover, unit 200 can control the geared motors which cooperate to drive one and the same roller in a coordinated manner. For example, when detector 91 associated with damper 74 has detected a pivoting movement of arm 71 about axis $X_{53}$, unit 200 is informed thereof thanks to signal $S_1$. Taking account of this signal, unit 200 can control geared motor 66 in order that the latter drives shaft 56 in such a way as to compensate, at pinions 54 and 55 and racks 26 and 28, for the angular shift that is produced about axis $X_{53}$. This allows the equilibrium of the vertical forces exerted on carriage 24 by the various pinion/rack assemblies to be ensured.

In the same way, if one of the detectors associated with one of dampers 174, 174', 176 and 176' detects the pivoting movement of one of arms 171, 171', 172 or 172', unit 200 can control the geared motors other than that supported by the reaction arm whose pivoting movement has been detected in order to compensate for any disequilibrium in the actuation of column 13 or plate 16. It can thus be ensured that mandrel 12 and seating 17 are always correctly aligned and that carriage 13-19 is not subjected to forces capable of deforming it. This coordination of the action of the geared motors is possible due to the fact that the irregularities of the workpiece to be treated are rapidly detected thanks to the articulated reaction arms and the associated detectors.

It emerges from the preceding explanations that each of carriages 13-19 or 24 for the horizontal or vertical displacement in translation of rollers 12 or 22 carries four racks 25 to 28, 125, 127 or equivalent which each cooperate with a pinion 51, 52, 54, 55, 151 or equivalent. This permits the forces to which these carriages are subjected to be distributed.

The invention is represented at the time of its use for controlling the position of shaping rollers 12 and 22. It can be used solely to control a single one of these shaping rollers. Similarly, its use for controlling centering arms 200 and 202 is optional.

Cage 4 is provided with a geared motor 461 which drives a pinion 451 engaged with a rack 462 which extends over main frame 2 parallel to the axis $X_2$. It is thus possible to control the position of axial cage 4 along axis $X_2$.

Geared motor 461 is supported by a reaction arm 471 which is articulated on frame 41 of cage 4 about an axis parallel to the output axis of geared motor 461.

The invention has been described with damping means constituted by piston dampers and a stack of Belleville washers. Other types of dampers can be envisaged, in particular dampers with helical compression springs, gas dampers or elastomer block dampers.

The invention claimed is:

1. A circular rolling mill for the shaping of an annular workpiece having a radial inner face, a radial outer face, and first and second front faces, said rolling mill comprising:

a frame;

an inner roller and an outer roller capable of performing work on the radial inner face and the radial outer face, respectively;

an upper conical roller and a lower conical roller capable of performing work on the first and second front faces, respectively;

at least a first pinion/rack assembly selected from the group consisting of a pinion/rack assembly for moving the inner roller and a pinion/rack assembly for moving the upper conical roller, said first pinion/rack assembly comprising a first pinion, and a first rack which is secured to a member, wherein the first pinion is rotated about an axis of rotation by an output shaft of a first electrically operated geared motor mounted on a first support, wherein the first support is articulated with respect to the frame about the axis of rotation and exhibits pivoting movement about an articular axis of the first support; and a first damping device for damping the pivoting movement.

2. The rolling mill according to claim 1, wherein the upper conical roller is mounted on a first carriage displaceable in a vertical direction and on which the first rack is fixed, the first pinion/rack assembly being capable of exerting on the first carriage a vertical force directed towards the lower conical roller.

3. The rolling mill according to claim 2, further comprising a second pinion/rack assembly comprising a second pinion and a second rack, wherein the inner roller is mounted on a second carriage displaceable in a horizontal direction and on which the second rack is fixed, the second pinion/rack assembly being capable of exerting on the second carriage a horizontal force directed towards the outer roller.

4. The rolling mill according to claim 3, wherein each of the first and second pinions is rotated by the output shaft of the first electrically operated geared motor.

5. The rolling mill according to claim 1, further comprising at least one centering roller for tracking and centering the radial outer face of the workpiece, and wherein the at least one centering roller is mounted on a mobile arm integral with a first centering pinion engaged with a second centering pinion, wherein the second centering pinion is driven by an output shaft of a second electrically operated geared motor mounted on a second support wherein the second support is articulated with respect to the frame about a second axis of rotation of the second centering pinion and exhibits pivoting movement about an articulated axis of the second support, and wherein a second damping device is provided between the second support and the frame in order to damp the pivoting movement.

6. The rolling mill according to claim 5, further comprising first and second detectors for detecting the pivoting movement of the first and second supports respectively with respect to the frame, said each of the first and second detectors being capable of supplying a respective signal representative of the pivoting movement to an electronic control unit of the rolling mill.

7. The rolling mill according to claim 6, wherein the electronic unit is capable of controlling said first and second electrically operated geared motors as a function of the signals received from the first and second detectors in order to ensure a coordinated operation of the first pinion/rack assembly.

8. The rolling mill according to claim 5, wherein each of the first and second damping devices comprises a rod linked to the first and second supports and integral with a mobile piston inside a body which is integral with the frame, thereby defining a variable-volume chamber, and wherein said chamber contains an element which is elastically deformable by compression.

9. The rolling mill according to claim 8, further comprising a detector capable of detecting a displacement with respect to the body of the rod linked to the first and second supports.

10. The rolling mill according to claim 8, wherein the elastically deformable element is a stack of Belleville washers.

* * * * *

UNITED STATES PATENT AND TRADEMARK OFFICE

CERTIFICATE OF CORRECTION

PATENT NO. : 8,683,838 B2
APPLICATION NO. : 12/736629
DATED : April 1, 2014
INVENTOR(S) : Vinzant et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 699 days.

Signed and Sealed this
Twenty-ninth Day of September, 2015

Michelle K. Lee

Michelle K. Lee
*Director of the United States Patent and Trademark Office*